US006698807B1

(12) United States Patent
Wacker

(10) Patent No.: US 6,698,807 B1
(45) Date of Patent: Mar. 2, 2004

(54) LATCH GUARD

(76) Inventor: Bruce W. Wacker, 221 W. Meuse, Blue Grass, IA (US) 52726

( * ) Notice: Subject to any disclaimer, the term of this patent is extended or adjusted under 35 U.S.C. 154(b) by 0 days.

(21) Appl. No.: 10/135,661

(22) Filed: Apr. 30, 2002

(51) Int. Cl.[7] ..... E05B 15/02

(52) U.S. Cl. ..... 292/341.14; 292/1; 292/DIG. 2

(58) Field of Search ..... 292/1, 341.14, 292/346, DIG. 2, DIG. 45, 19; 24/297, 458, 530; 362/396, 249; 248/74.2, 316.7

(56) References Cited

U.S. PATENT DOCUMENTS

| | | | | | |
|---|---|---|---|---|---|
| 969,524 | A | * | 9/1910 | Condon | |
| 2,726,892 | A | | 12/1955 | Zyndia et al. | |
| 2,745,690 | A | * | 5/1956 | Thornell | 292/1 |
| 2,760,803 | A | * | 8/1956 | Solomon | 292/1 |
| 3,458,227 | A | | 7/1969 | Bryson et al. | |
| 3,826,526 | A | * | 7/1974 | Wepsala | 292/346 |
| 3,954,238 | A | * | 5/1976 | Nivet | 248/68 CB |
| 4,159,838 | A | | 7/1979 | Wilzig et al. | |
| 4,305,611 | A | * | 12/1981 | Robins | 292/238 |
| 4,378,948 | A | * | 4/1983 | Chrones | 292/19 |
| 4,453,752 | A | | 6/1984 | McKann | |
| 4,834,186 | A | * | 5/1989 | Ballard | 169/16 |
| 5,004,279 | A | * | 4/1991 | Radcliff | 292/288 |
| 5,613,718 | A | * | 3/1997 | Lin | 292/346 |
| 6,082,790 | A | | 7/2000 | Mossotti et al. | |
| D435,684 | S | * | 12/2000 | Gary | D26/138 |

* cited by examiner

*Primary Examiner*—Gary Estremsky
(74) *Attorney, Agent, or Firm*—Sturm & Fix LLP

(57) ABSTRACT

A latch guard for covering a door latch opening in a door jamb. Covering the door latch opening in a door jamb enables a door to be opened easily without requiring opening of a door knob. The latch guard contains a C-shaped piece attached to a rectangular piece. The C-shaped piece fits into the door latch opening in a door jamb. The rectangular piece serves as a backing to the C-shaped piece, and the rectangular piece lies flat against a door jamb when the latch guard is installed in a door latch opening in a door jamb. The latch guard is easily installable and removable.

1 Claim, 1 Drawing Sheet

LATCH GUARD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

This present invention relates to the field of door anti-latch devices, and more particularly to door anti-latch devices insertable into the door latch opening in a door jamb that are easily installable and easily removable.

2. Description of the Related Art

Door latch anti-locking devices are well known in the art. Typical door latch anti-locking devices are not easily installable and easily removable. As can be seen by reference to the following U.S. Pat. Nos. 6,082,790, and 2,726,892, the prior art is replete with myriad and diverse door latch anti-locking devices. U.S. Pat. No. 6,082,790, titled "Door Anti-Locking Device", is an invention designed to provide a plate for covering a door striker plate on a door jamb to prevent a door from latching, but the invention is distinguished from the present invention by the lack of easy removability. The plate is screwed permanently to the door latch area. By contrast, the present invention is easily removable from a door striker plate after use. In addition, U.S. Pat. No. 2,726,892, titled "Safety Lock Clip", is also an invention designed to serve as an anti-latch device for a door latch, but it also is not easily removable, and is screwed into place.

While all of the aforementioned prior art constructions are more than adequate for the basic purpose and function for which they have been specifically designed, they are uniformly deficient with respect to their failure to provide a simple, efficient, and practical easily installable and easily removable device insertable into the door latch opening in a door jamb. As a consequence of the foregoing situation, there has existed a longstanding need for a new and improved door latch guard, and the provision of such a construction is a stated objective of the present invention.

BRIEF SUMMARY OF THE INVENTION

Briefly stated, the present invention provides a door latch guard comprised of a rigid rectangular piece and a rigid C-shaped piece. The center of the C-shaped piece is attached to the center of the rectangular piece. The C-shaped piece fits securely into the door latch opening in a door jamb, thereby preventing a door latch from latching the door. The rectangular piece serves as a backing to the C-shaped piece, and the rectangular piece lies flat against a door jamb when the latch -guard is installed in a door latch opening in a door jamb. Preventing a door from latching allows groups such as maintenance personnel to keep a door from latching. This allow the maintenance personnel to easily enter and exit the door when frequent trips through the door are necessary.

The door latch guard may be made form material such as hose, plastic pipe, or plastic cup. Various methods may be used to manufacture the door latch guard, such as using a pop rivet to secure the C-shaped piece to the rectangular backing piece, or to create the entire door latch guard of a single molded plastic piece.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE BEST MODE

Figure 1:
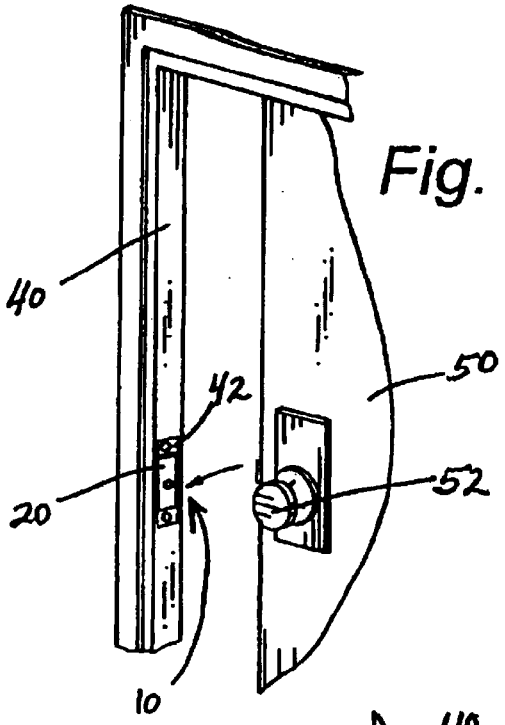
FIG. 1 is a perspective view of the present invention inserted into a door latch opening in a door jamb.
Figure 2:
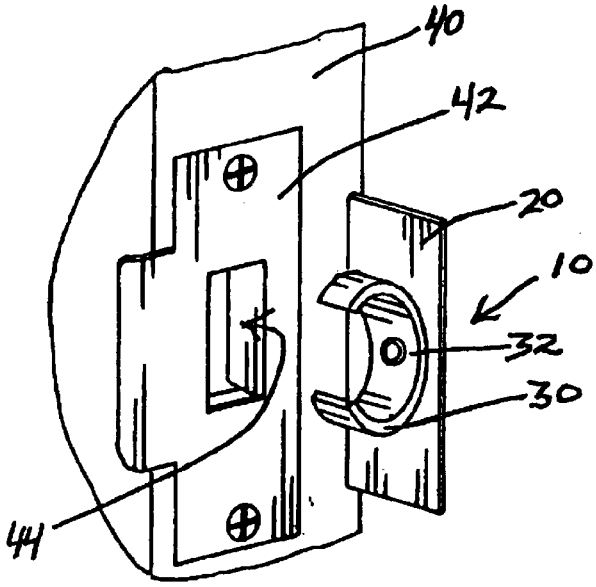
FIG. 2 is a side perspective view of the present invention displayed adjacent a door latch opening in a door jamb.

As can be seen by reference to the drawings, and particular to FIG. 1, the latch guard that forms the basis of the present invention is designated generally by the reference number 10. As seen in FIG. 2, the latch guard contains a rectangular plate 20, and a C-shaped piece 30 attached to the rectangular plate 20 at the back of the C-shaped piece 32.

The door latch guard 10 may be made from, for example, hose, plastic pipe, or plastic cup. In one embodiment, the C-shaped piece 30 of the door latch guard 10 is made from 1½ inch diameter plastic pipe, is ½ inch wide, and the rectangular piece 20 is 0.03 inches thick and 1¼ inches wide. The C-shaped piece 30 is secured to the rectangular piece 20 by, for example, a pop rivet. The latch guard 10 may also be formed from a single molded plastic piece.

Figure 3:
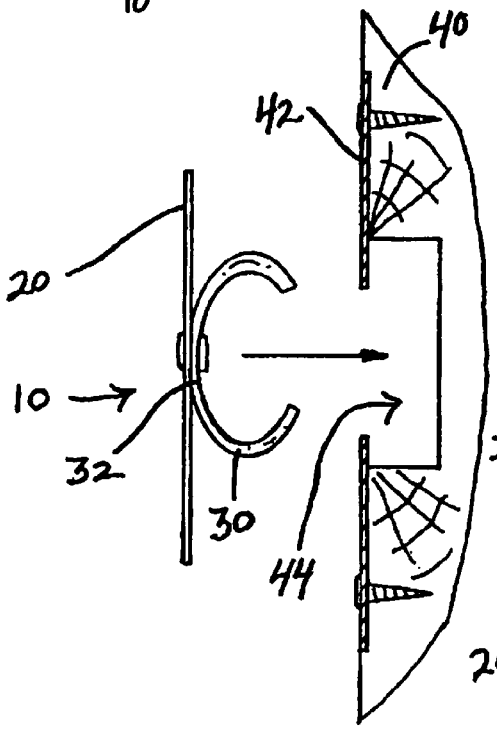
FIG. 3 is a side elevation view of the present invention immediately prior to being inserted into a door latch opening in a door jamb.
Figure 4:
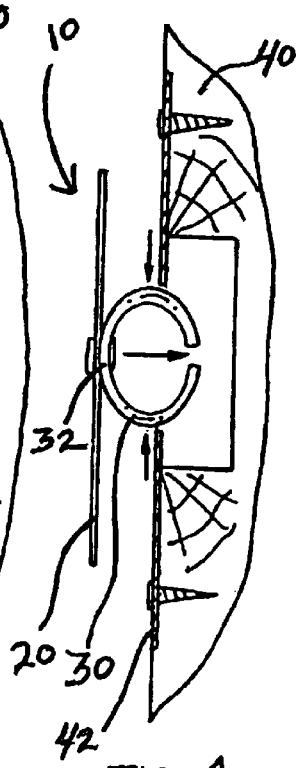
FIG. 4 is a side elevation view of the present invention with the C-shaped piece partially inserted into the door latch opening in a door jamb.
Figure 5:
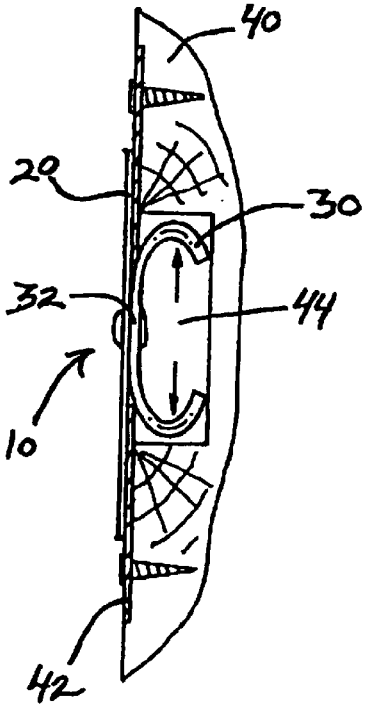
FIG. 5 is a side elevation view of the present invention completely installed into the door latch opening in a door jamb.

In use, as seen in FIG. 3, the latch guard 10 is placed adjacent to a striker plate 42 in a door jamb 40. As seen in FIG. 4, the C-shaped piece 30 is then placed into the opening 44 in the door jamb 40. When the C-shaped piece 30 is entered into the door jamb 40, the C-shaped piece 30 compresses inwardly. Then, as seen in FIG. 5, the C-shaped piece 30 expands into place within the opening 44 in the door jamb 40. The latch guard 10 is locked into place, and will remain in the door jamb 40 until the user desires to remove the latch guard 10. The latch guard 10 is useful to, for example, maintenance personnel who need to make multiple trips into a room, and must carry supplies. The latch guard 10 allows a door 50 to swing freely without the need to open the door 50 with the door knob 52.

The user removes the latch guard 10 by the reverse of the process above used to install the latch guard 10. As seen in FIG. 5, the latch guard 10 is initially in the installed position.

The user pulls outwardly on the latch guard 10 until the C-shaped piece 30 compresses inwardly (FIG. 4). Further pulling on the latch guard 10 results in the latch guard 10 being completely removed from the opening 44 in the door jamb 40, as shown in FIG. 3.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. In a door having a door jamb, an opening formed into the door jamb, a striker plate fixed to the door jamb adjacent the opening, and door knob with latch movable to selectively engage the opening, the improvement comprising a latch guard having, a plate;

a C-shaped member fixed to said plate;

said C-shaped member movable to fit through the striker plate into the opening, said plate disposed against the striker plate over the opening, the door knob with latch movable against said plate, whereby the door swings freely open without engagement of the door knob.

* * * * *